US009396827B2

(12) United States Patent
Gao et al.

(10) Patent No.: US 9,396,827 B2
(45) Date of Patent: Jul. 19, 2016

(54) CU—TI BASED COPPER ALLOY SHEET MATERIAL AND METHOD FOR PRODUCING THE SAME, AND ELECTRIC CURRENT CARRYING COMPONENT

(71) Applicant: DOWA METALTECH CO., LTD., Tokyo (JP)

(72) Inventors: Weilin Gao, Tokyo (JP); Motohiko Suzuki, Tokyo (JP); Toshiya Kamada, Tokyo (JP); Takashi Kimura, Tokyo (JP); Fumiaki Sasaki, Tokyo (JP); Akira Sugawara, Tokyo (JP)

(73) Assignee: DOWA METALTECH CO., LTD., Tokyo (JP)

( * ) Notice: Subject to any disclaimer, the term of this patent is extended or adjusted under 35 U.S.C. 154(b) by 141 days.

(21) Appl. No.: 14/211,067

(22) Filed: Mar. 14, 2014

(65) Prior Publication Data

US 2014/0283963 A1 Sep. 25, 2014

(30) Foreign Application Priority Data

Mar. 25, 2013 (JP) ..... 2013-061498

(51) Int. Cl.
*H01B 1/02* (2006.01)
*C22C 9/00* (2006.01)
*C22F 1/08* (2006.01)

(52) U.S. Cl.
CPC *H01B 1/026* (2013.01); *C22C 9/00* (2013.01); *C22F 1/08* (2013.01)

(58) Field of Classification Search
CPC ..... H01B 1/026; C22C 9/00; C22F 1/08
See application file for complete search history.

(56) References Cited

U.S. PATENT DOCUMENTS

2009/0101243 A1* 4/2009 Aruga ..... C22C 1/06 148/412
2010/0132851 A1* 6/2010 Gao ..... C22C 9/00 148/554
2010/0139822 A1* 6/2010 Gao ..... C22C 1/002 148/682

FOREIGN PATENT DOCUMENTS

JP 2012-087343 5/2012
JP 2012-097308 5/2012

* cited by examiner

*Primary Examiner* — Veronica F Faison
(74) *Attorney, Agent, or Firm* — Clark & Brody

(57) ABSTRACT

A Cu—Ti based copper alloy sheet material contains, in mass %, from 2.0 to 5.0% of Ti, from 0 to 1.5% Ni, from 0 to 1.0% Co, from 0 to 0.5% Fe, from 0 to 1.2% Sn, from 0 to 2.0% Zn, from 0 to 1.0% Mg, from 0 to 1.0% Zr, from 0 to 1.0% Al, from 0 to 1.0% Si, from 0 to 0.1% P, from 0 to 0.05% B, from 0 to 1.0% Cr, from 0 to 1.0% Mn, and from 0 to 1.0% V, the balance substantially being Cu. The sheet material has a metallic texture wherein in a cross section perpendicular to a sheet thickness direction, a maximum width of a grain boundary reaction type precipitate is not more than 500 nm, and a density of a granular precipitate having a diameter of 100 nm or more is not more than $10^5$ number/$mm^2$.

10 Claims, 2 Drawing Sheets

CU—TI BASED COPPER ALLOY SHEET MATERIAL AND METHOD FOR PRODUCING THE SAME, AND ELECTRIC CURRENT CARRYING COMPONENT

TECHNICAL FIELD

The present invention relates to a Cu—Ti BASED copper alloy sheet material suitable for electric current carrying components such as connectors, lead frames, relays, and switches, and in particular, the present invention relates to a sheet material having conspicuously improved fatigue resistance and a method for producing the same. In addition, the present invention relates to an electric current carrying component using the copper alloy sheet material for a material.

BACKGROUND ART

Materials which are used for electric current carrying components constituting electrical or electronic components such as connectors, lead frames, relays, and switches are required to have high "strength" capable of withstanding a stress which is given at the time of assembling or operation of an electrical or electronic appliance. In addition, materials used for electrical or electronic components are required to have excellent "bending workability" because said components are generally formed by bending. Furthermore, in order to ensure contact reliability between electrical or electronic components, durability against a phenomenon in which a contact pressure decreases with time (stress relaxation), namely excellent "stress relaxation resistance" is required, too. The stress relaxation as referred to herein is a kind of creep phenomenon in which even if the contact pressure of a spring part of an electric current carrying component constituting an electrical or electronic component is kept in a fixed state at ordinary temperature, it decreases with time under an environment of relatively high temperatures (for example, from 100 to 200° C.). That is, the stress relaxation means a phenomenon in which in a state where a stress is given to a metal material, dislocation moves due to self-diffusion of atoms constituting the matrix or diffusion of a solute atom to cause plastic deformation, whereby the given stress is relieved. When used in an environment where an increase of the component temperature as in automobile connectors is supposed, the "stress relaxation resistance" is particularly important.

In the light of the above, materials which are used for electrical or electronic components are required to have excellent "strength", "bending workability", and "stress relaxation resistance". Meanwhile, electric current carrying components having a movable portion, such as relays and switches, are also required to have excellent "fatigue resistance" in terms of durability capable of withstanding a repeated stress load. But, in general, the "fatigue resistance" or "bending workability" is in a trade-off relationship with the "strength", and in copper alloy sheet materials, it is not easy to enhance the "fatigue resistance" or "bending workability" at the same time while contemplating to achieve high strength.

Among copper alloys, a Cu—Ti based copper alloy has high strength just below a Cu—Be based copper alloy and has stress relaxation resistance superior to the Cu—Be copper alloy. In addition, the Cu—Ti based copper alloy is more advantageous than the Cu—Be copper alloy from the standpoints of cost and environmental load. For that reason, the Cu—Ti based copper alloy (for example, C1990 which is a Cu-3.2% by mass Ti alloy) is used for connector materials or the like as an alternate material of the Cu—Be based copper alloy. But, the Cu—Ti based copper alloy is generally inferior in the "fatigue resistance" and "bending workability" to the Cu—Be copper alloy having equal strength.

CITATION LIST

Patent Literatures

Patent Literature 1: JP-A-2012-87343 ("JP-A" means unexamined published Japanese patent application)

Patent Literature 2: JP-A-2012-97308

SUMMARY OF INVENTION

Problems to be Solved by the Invention

As is well known, the Cu—Ti based copper alloy is an alloy capable of enhancing the strength utilizing a modulated structure (spinodal structure) of Ti. The modulated structure is a structure which is formed while keeping complete consistency with a mother phase due to a continuous fluctuation in the concentration of a Ti solute atom. Though the material is conspicuously hardened by the modulated structure, a loss of the fatigue resistance or bending workability to be caused due to this matter is relatively small.

Meanwhile, Ti in the Cu—Ti based copper alloy mother phase forms an intermetallic compound (β phase) with Cu to precipitate as a second phase grain in the crystal grain boundary or the grain. In this specification, a granular precipitate including an intermetallic compound of this kind is generically named "granular precipitate". The greater part of the granular precipitate observed in the Cu—Ti based copper alloy is a grain of the above-described β phase. In addition, when Ti in the mother phase reacts with Cu in the crystal grain boundary, a striped intermetallic compound precipitates from the grain boundary and grows. The intermetallic compound phase of this kind is named "precipitate of grain boundary reaction type".

The granular precipitate is small in its own hardening action, so that when a large amount of the granular precipitate precipitates, it brings a decrease of the concentration of a solute Ti atom constituting a modulated structure, thereby becoming a factor to hinder the enhancement of strength. In addition, the precipitate of grain boundary reaction type is a weak portion and easily becomes a starting point of fatigue fracture. Patent Literature 2 discloses a technology for improving the strength, electrical conductivity, and bending workability by increasing an existent ratio of a precipitate of grain boundary reaction type which is occupied in a precipitation phase in a Cu—Ti based copper alloy. It is said that coarsening of a stable phase (granular precipitate) is suppressed due to the formation of a precipitate of grain boundary reaction type, and as a result, a 0.2% offset yield strength of 850 MPa or more can be realized while suppressing a decrease of the bending workability. But, according to investigations made by the present inventors, the precipitate of grain boundary reaction type is originally a weak portion, and the precipitate of grain boundary reaction type itself becomes a factor to decrease the strength or bending workability. In particular, in order to improve the fatigue resistance, it is necessary to suppress the formation of a precipitate of grain boundary reaction type.

In the case of a Cu—Be based copper alloy, by adding Co or Ni, such an additive element segregates in the grain boundary, thereby making it possible to suppress the precipitation of grain boundary reaction type. However, in the Cu—Ti based copper alloy, in view of the fact that Ti is a very active element, the additive element is easily consumed through the formation of a compound with Ti, so that an effect for suppressing the precipitation of grain boundary reaction type utilizing the segregation in the grain boundary is small. In addition, a primary strengthening mechanism of the Cu—Ti based copper alloy is one derived from a modulated structure (spinodal structure) of solid-solved Ti, and therefore, the addition of a large amount of a third element decreases the amount of solid-solved Ti to offset the merits of the Cu—Ti based copper alloy each other.

The precipitate of grain boundary reaction type of the Cu—Ti based copper alloy is formed chiefly in an aging treatment process. It is the present state that a technology for effectively suppressing the formation of a precipitate of grain boundary reaction type has not been established yet, and it may be considered that it is difficult to enhance the fatigue resistance of the Cu—Ti based copper alloy. The present invention is to provide a Cu—Ti based copper alloy sheet material having improved "fatigue resistance" while keeping the "strength", "bending workability", and "stress relaxation resistance" good.

Means for Solving the Problems

The aging treatment temperature for bringing out a maximum strength of the Cu—Ti based copper alloy is generally from about 450 to 500° C. But, the precipitation of grain boundary reaction type is simultaneously caused in this temperature region. As a result of detailed investigations made by the present inventors, it has been found that by performing a heat treatment in a temperature region of from 550 to 730° C. after a solution treatment, a precursory texture state of the modulated structure is obtained; and that in those having such a texture state, the aging treatment temperature at which a maximum strength is obtained shifts towards the low-temperature side. Specifically, it becomes possible to achieve the aging treatment at low temperatures as from 300 to 430° C. In that temperature region, the formation of a precipitate of grain boundary reaction type can be effectively suppressed. The present invention has been accomplished on the basis of such knowledge.

Specifically, the above-described object is achieved by a copper alloy sheet material which comprises from 2.0 to 5.0% of Ti, from 0 to 1.5% of Ni, from 0 to 1.0% of Co, from 0 to 0.5% of Fe, from 0 to 1.2% of Sn, from 0 to 2.0% of Zn, from 0 to 1.0% of Mg, from 0 to 1.0% of Zr, from 0 to 1.0% of Al, from 0 to 1.0% of Si, from 0 to 0.1% of P, from 0 to 0.05% of B, from 0 to 1.0% of Cr, from 0 to 1.0% of Mn, and from 0 to 1.0% of V in terms of % by mass, with a total content of Sn, Zn, Mg, Zr, Al, Si, P, B, Cr, Mn, and V being not more than 3.0% and the balance being Cu and inevitable impurities, wherein the copper alloy sheet material has a metallic texture in which in a cross section thereof perpendicular to the sheet thickness direction, a maximum width of a precipitate of grain boundary reaction type is not more than 500 nm, and a density of a granular precipitate having a diameter of 100 nm or more is not more than $10^5$ number/mm$^2$. A copper alloy sheet material having a metallic texture in which in a cross section thereof perpendicular to the sheet thickness direction, an average crystal grain diameter is from 5 to 25 μm is more suitable for the subject. An electrical conductivity of 15% IACS or more can be ensured. The maximum width of the precipitate of grain boundary reaction type as referred to herein means a maximum value of a length of the precipitate of grain boundary reaction type in the rectangular direction to a crystal grain boundary on which the precipitate of grain boundary reaction type is formed, the length being measured at a position above the crystal grain boundary in the observation of metallic texture. The "diameter" of the granular precipitate means a major axis of the grain in the observation of metallic texture.

In the above-described copper alloy sheet material, when the rolling direction of the sheet is defined as LD, and the direction rectangular to the rolling direction and the sheet thickness direction is defined as TD, it is possible to realize a copper alloy sheet material having a 0.2% offset yield strength in LD of 850 MPa or more and having bending workability such that in the 90° W-bending test in conformity with JIS H3130, a value of R/t ratio of a minimum bending radius R to a sheet thickness t at which cracking does not occur is not more than 2.0 in both LD and TD. In addition, with respect to the fatigue properties, it is possible to provide a copper alloy sheet material having excellent fatigue resistance such that in the fatigue test in conformity with JIS Z2273, in a test piece in which the rolling direction of the sheet is the longitudinal direction, a fatigue life at a maximum load stress of 700 MPa on the test piece surface (the number of repeated vibrations until rupture of the test piece occurs) is 500,000 times or more. The above-described copper alloy sheet material is extremely useful as a material for working into an electric current carrying component. Though the sheet thickness of the above-described copper alloy sheet material can be made to, for example, from 0.05 to 1.0 mm, in order to respond to thin-wall processing of an electric current carrying component, it is preferable to make the sheet thickness of the copper alloy sheet material to, for example, from 0.05 to 0.35 mm.

The above-described copper alloy sheet material can be obtained by a production method including a step of subjecting a sheet material having been subjected to hot rolling and cold rolling at a rolling ratio of 90% or more, to a heat treatment with a heat pattern including a solution treatment at from 750 to 950° C., holding at a temperature ranging from 550 to 730° C. in a cooling process after the solution treatment for from 10 to 120 seconds, and then rapidly cooling to at least 200° C. at an average cooling rate of 20° C./sec or more; and a step of subjecting the sheet material after the heat treatment successively to intermediate cold rolling at a rolling ratio of from 0 to 50%, an aging treatment at from 300 to 430° C., and finish cold rolling at a rolling ratio of from 0 to 30%.

In addition, after carrying out the solution treatment by means of a usual step, a step of reheating at a temperature ranging from 550 to 730° C. can also be adopted as a pretreatment of the aging treatment. In that case, there can be applied a production method including a step of subjecting a sheet material having been subjected to hot rolling and cold rolling at a rolling ratio of 90% or more, to a heat treatment with a heat pattern including a solution treatment at from 750 to 950° C., then quenching to at least 200° C. at an average cooling rate of 20° C./sec or more, thereafter increasing the temperature and holding at a temperature ranging from 550 to 730° C. for from 10 to 120 seconds, and then quenching to at least 200° C. at an average cooling rate of 20° C./sec or more; and a step of subjecting the sheet material after the heat treatment successively to intermediate cold rolling at a rolling ratio e of from 0 to 50%, an aging treatment at from 300 to 430° C., and finish cold rolling at a rolling ratio of from 0 to 30%.

The "rolling ratio of 0%" as referred to herein means that the rolling is not carried out. That is, the intermediate cold rolling or finish cold rolling can be omitted. In the case of carrying out the finish cold rolling, it is preferable to adopt a step of controlling its rolling ratio to from 5 to 30% and then applying low-temperature annealing at from 150 to 430° C. In addition, it is preferable to adjust a heating time and an in-furnace time in the solution treatment such that an average crystal grain diameter in a cross section perpendicular to the sheet thickness direction after the final cold rolling is from 5 to 25 μm.

Advantages of the Invention

According to the present invention, it has become possible to provide a Cu—Ti based copper alloy sheet material which is excellent in strength, bending workability, and stress relaxation resistance and is also excellent in fatigue resistance. The present invention is useful for needs of downsizing and thin-wall processing of electrical or electronic components, which will be expected to be developed more and more in the future.

MODES FOR CARRYING OUT THE INVENTION

<<Alloy Composition>>

Figure 1:
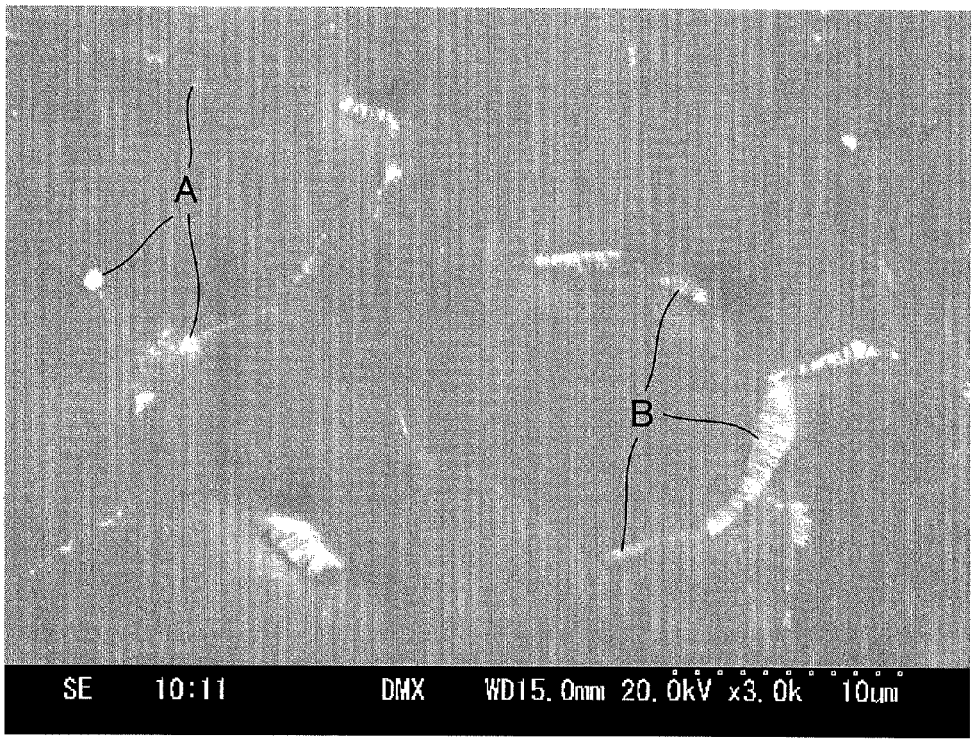
FIG. 1 is an SEM photograph of metallic texture of a general Cu—Ti based copper alloy.

In the present invention, a Cu—Ti based copper alloy in which a binary basic component of Cu—Ti is blended with Ni, Co, Fe, and other alloying elements, if desired is adopted. The term "%" regarding the alloy composition hereunder means "% by mass" unless otherwise indicated.

Ti is an element having a high age hardening action in a Cu matrix and contributes to an increase of the strength and an enhancement of the stress relaxation resistance. In order to sufficiently bring out these actions, it is advantageous to ensure the Ti content of preferably 2.0% or more, and more preferably 2.5% or more. On the other hand, when the Ti content is in excess, cracking easily occurs during a hot working or cold working process, and a lowering of productivity is easily brought. In addition, the temperature region in which the solution treatment can be achieved becomes narrow, so that it becomes difficult to bring out good properties. As a result of various investigations, it is necessary to control the Ti content to not more than 5.0%. The Ti content is adjusted within the range of preferably not more than 4.0%, and more preferably not more than 3.5%.

Each of Ni, Co, and Fe is an element which contributes to an enhancement of the strength upon formation of an intermetallic compound with Ti, and at least one member of these elements can be added, if desired. In particular, in the solution treatment of the Cu—Ti based copper alloy, since such an intermetallic compound suppresses coarsening of the crystal grain, it is possible to carry out the solution treatment in a higher temperature region, and such is advantageous in sufficiently achieving solid-solution of Ti. As to the content in the case of adding at least one member of these elements, it is more effective to contain 0.05% or more of Ni, 0.05% or more of Co, and 0.05% or more of Fe, respectively, and it is still more effective to contain 0.1% or more of Ni, 0.1% or more of Co, and 0.1% or more of Fe, respectively. However, when each of Fe, Co, and Ni is contained in excess, the amount of Ti which is consumed by the formation of the resulting intermetallic compound becomes large, so that the amount of solid-solved Ti becomes small inevitably. In that case, conversely, a lowering of the strength is easily brought. In consequence, in the case of adding at least one member of Ni, Co, and Fe, the contents of Ni, Co, and Fe are controlled to the ranges of not more than 1.5%, not more than 1.0%, and not more than 0.5%, respectively. The contents of Ni, Co, and Fe may also be controlled to the ranges of not more than 0.25%, not more than 0.25%, and not more than 0.25%, respectively.

Sn has an action to strengthen solid solution and an action to enhance stress relaxation resistance. It is more effective to ensure the Sn content of 0.1% or more. However, when the Sn content exceeds 1.0%, castability and electrical conductivity are conspicuously lowered. For that reason, in the case of containing Sn, it is necessary to control the Sn content to not more than 1.0%. The Sn content may also be controlled to the range of not more than 0.5%, or not more than 0.25%.

Zn has actions to enhance soldering properties and strength, and besides, it also has an action to improve castability. Furthermore, in the case of containing Zn, there is brought such an advantage that an inexpensive brass scrap can be used. However, an excess of the Zn content easily becomes a factor to cause a lowering of electrical conductivity or stress corrosion cracking resistance. For that reason, in the case of containing Zn, it is necessary to control the Zn content to not more than 2.0%, and the Zn content may also be controlled to the range of not more than 1.0%, or not more than 0.5%. In order to sufficiently obtain the above-described actions, it is desirable to ensure the Zn content of 0.1% or more, and in particular, it is more effective to control the Zn content to 0.3% or more.

Mg has an action to enhance stress relaxation resistance and a desulfurizing action. In order to sufficiently exhibit these actions, it is preferable to ensure the Mg content of 0.01% or more, and it is more effective to control the Mg content to 0.05% or more. However, Mg is an element which is easily oxidized, and when the Mg content exceeds 1.0%, castability is conspicuously lowered. For that reason, in the case of containing Mg, it is necessary to control the Mg content to not more than 1.0%, and it is more preferable to adjust the Mg content within the range of not more than 0.5%. In general, the Mg content may be controlled to not more than 0.1%.

As other elements, it is possible to contain at least one member of Zr of not more than 1.0%, Al of not more than 1.0%, Si of not more than 1.0%, P of not more than 0.1%, B of not more than 0.05%, Cr of not more than 1.0%, Mn of not more than 1.0%, and V of not more than 1.0%. For example, each of Zr and Al is able to form an intermetallic compound with Ti, and Si is able to form a precipitate with Ti. Each of Cr, Zr, Mn, and V easily forms a high melting-point compound with S, Pb, or the like which exists as an inevitable impurity. In addition, each of Cr, B, P, and Zr has a refining effect of the cast texture and may contribute to an improvement of hot workability. In the case of containing at least one of Zr, Al, Si, P, B, Cr, Mn, and V, in order to sufficiently obtain the actions of the respective elements, it is effective to contain such an element in an amount of 0.01% or more in total.

However, what a large amount of at least one member of Zr, Al, Si, P, B, Cr, Mn, and V is contained adversely affects the hot or cold workability and is disadvantageous from the standpoint of cost. In consequence, it is desirable to control a total content of Sn, Zn, Mg, Zr, Al, Si, P, B, Cr, Mn, and V to not more than 3.0%. The total content can be controlled to the range of not more than 2.0% or not more than 1.0%, and it may be controlled to the range of not more than 0.5%. As for a more rational upper limit taking the economy into account, for example, it can be controlled to not more than 0.2% for Zr, not more than 0.15% for Al, not more than 0.2% for Si, not more than 0.05% for P, not more than 0.03% for B, not more than 0.2% for Cr, not more than 0.1% for Mn, and not more than 0.2% for V, respectively.

<<Metallic Texture>>

An SEM photograph of metallic texture of a general Cu—Ti based copper alloy is illustrated in FIG. 1. A "granular precipitate" of a type shown by a symbol A, and a "precipitate of grain boundary reaction type" of a type shown by a symbol B are observed. However, a strengthening mechanism of the Cu—Ti based copper alloy is one mainly derived from a modulated structure (spinodal structure). Different from the precipitate, the modulated structure itself is not observed by an optical microscope or SEM.

[Granular Precipitate]

As for the granular precipitate observed in a mother phase (matrix) of the Cu—Ti based copper alloy, though intermetallic compounds such as Ni—Ti, Co—Ti, and Fe—Ti intermetallic compounds may be existent depending upon the kind of the alloying element to be added, a β phase that is a Cu—Ti intermetallic compound occupies the majority in quantity. In the case where the grain diameter of the granular precipitate is small as, for example, from several nm to several tens of nm, not only the hardening action effectively reveals, but a loss of ductility is small. On the other hand, in a granular precipitate having a diameter of 100 nm or more, nevertheless the hardening action is small, a loss of ductility is large. In addition, when a large amount of such a coarse granular precipitate is formed, the concentration of a Ti solute atom in the modulated structure decreases, and a lowering of the strength is caused. As a result of various investigations, it is necessary to control a density of a granular precipitate having a diameter of 100 nm or more to not more than $10^5$ number/$mm^2$, and the density of a granular precipitate having a diameter of 100 nm or more is more preferably not more than $5\times10^4$ number/$mm^2$.

[Precipitate of Grain Boundary Reaction Type]

According to investigations made by the present inventors, the precipitate of grain boundary reaction type is a very weak portion and becomes a factor to bring a lowering of the strength or a lowering of the stress relaxation resistance. In addition, the precipitate of grain boundary reaction type becomes a starting point of fatigue fracture or bending cracking. In particular, in order to improve the stress relaxation resistance, it has been noted that it is extremely effective to strictly control the formation amount of the precipitate of grain boundary reaction type. As a result of detailed studies, when in a cross section perpendicular to the sheet thickness direction, a maximum width of the precipitate of grain boundary reaction type is not more than 500 nm, it is possible to stably realize excellent fatigue resistance such that a fatigue life at a maximum load stress of 700 MPa in the fatigue test in conformity with JIS Z2273 is 500,000 times or more. The maximum width of the precipitate of grain boundary reaction type is more preferably not more than 300 nm.

It is meant by the terms "in a cross section perpendicular to the sheet thickness direction, a maximum width of the precipitate of grain boundary reaction type is not more than X nm" that in the cross section perpendicular to the sheet thickness direction, namely in the observed surface of metallic texture prepared by polishing the sheet surface, in the case where a length of the precipitate of grain boundary reaction type is measured in the rectangular direction to the crystal grain boundary in a crystal grain boundary portion where the precipitate of grain boundary reaction type is formed, a maximum value of the foregoing length does not exceed X nm. The texture state in which the maximum width of the precipitate of grain boundary reaction type is not more than 500 nm or not more than 300 nm can be realized by production steps including a "precursory treatment" as described later.

[Average Crystal Grain Diameter]

What the average crystal grain diameter is smaller is advantageous for enhancing the bending workability. In the case where great importance is attached to the bending workability, the average crystal grain diameter of a final product sheet material is desirably not more than 25 μm. The average crystal grain diameter is adjusted to preferably not more than 20 μm, and more preferably not more than 15 μm. On the other hand, when the average crystal grain diameter is too small, the stress relaxation resistance is easily lowered. As a result of various investigations, in order to ensure a stress relaxation resistance level on which high evaluation is obtainable in an application of an onboard connector, the average crystal grain diameter of the final product sheet material is desirably 5 μm or more, and more desirably 8 μm or more. Control of the average crystal grain diameter can be mainly carried out by a solution treatment. The average crystal grain diameter can be determined by measuring the grain diameter of 100 or more crystal grains in a visual field of 300 μm×300 μm or more in the observation of metallic texture of the cross section perpendicular to the sheet thickness direction by the cutting method of JIS H0501.

<<Properties>>

[Electrical Conductivity]

When needs of weight-saving and thin-wall processing of electric current carrying components prepared by working a high-strength copper alloy sheet material are taken into account, it is advantageous that the copper alloy sheet material has an electrical conductivity of 15% IACS or more. The foregoing electrical conductivity can be satisfied by the above-described chemical composition and texture.

[Strength]

In order to respond to more downsizing and thin-wall processing of electrical or electronic components using a Cu—Ti based copper alloy, it is desirable that a 0.2% offset yield strength in LD is 850 MPa or more. The 0.2% offset yield strength in LD is controlled to a strength level of more preferably 900 MPa or more, and still more preferably 950 MPa or more. In addition, a tensile strength in LD is preferably 900 MPa or more, more preferably 950 MPa or more, and still more preferably 1,000 MPa or more. By applying a production condition as described later to an alloy satisfying the above-described chemical composition, it is possible to fulfill the above-described strength level at the same time while keeping the bending workability, fatigue resistance, and stress relaxation resistance high.

[Bending Workability]

In order to work the Cu—Ti based copper alloy sheet material into an electric current carrying component such as a connector, a lead frame, a relay, and a switch, it is advantageous that the Cu—Ti based copper alloy sheet material has good bending workability such that in the 90° W-bending test (width of test piece: 10 mm) in conformity with JIS H3130, a value of R/t ratio of a minimum bending radius R to a sheet thickness t at which cracking does not occur is preferably not more than 2.0, and more preferably not more than 1.0 in both LD and TD. The bending workability in LD is a bending workability which is evaluated with a bending working test piece cut out such that LD is the longitudinal direction, and the bending axis in that test is TD. Similarly, the bending workability in TD is a bending workability which is evaluated with a bending working test piece cut out such the TD is the longitudinal direction, and the bending axis in that test is LD.

[Fatigue Resistance]

In general, the fatigue resistance is evaluated in terms of the load stress of the test piece and the number of repeated vibrations until rupture of the test piece occurs (so-called "S—N curve"). The copper alloy sheet material which is subjective in the present invention is a copper alloy sheet material having fatigue resistance such that in the fatigue test in conformity with JIS Z2273, in a test piece in which the rolling direction (LD) of the sheet is the longitudinal direction, a fatigue life at a maximum load stress of 700 MPa on the test piece surface (the number of repeated vibrations until rupture of the test piece occurs) is preferably 500,000 times or more, and more preferably 700,000 times or more. In the Cu—Ti based copper alloy sheet material, though it was conventionally considered that it was difficult to make both the above-described high strength and such excellent fatigue resistance compatible with each other, it has become possible to realize this by steps including a precursory treatment as described later. It is also possible to obtain a copper alloy sheet material in which the above-described fatigue life is 1,000,000 times or more.

[Stress Relaxation Resistance]

As for the stress relaxation resistance, a value of TD is especially important in an application of an onboard connector or the like, and therefore, it is desirable to evaluate the stress relaxation properties in terms of a stress relaxation rate using a test piece in which the longitudinal direction thereof is TD. In an evaluation method of stress relaxation properties as described later, in the case of holding at 200° C. for 1,000 hours, the stress relaxation rate is preferably not more than 5%, and more preferably not more than 4%.

<<Production Method>>

The Cu—Ti based copper alloy sheet material which fulfills the above-described properties can be produced according to the following production steps.

"(Melting and casting)→(Hot rolling)→(Cold rolling) → (Solution treatment)→(Precursory treatment)→(Intermediate cold rolling)→(Aging treatment)→(Finish cold rolling)→(Low-temperature annealing)"

Here, the "precursory treatment" is a heating treatment in a specified temperature range, which is carried out between the solution treatment and the aging treatment. This is a heat treatment in which a so-called precursory modulated structure in which spinodal decomposition starts to occur slightly before the generation of a modulated structure (spinodal structure) in the aging treatment is considered to be formed. Incidentally, while the description is omitted in the above-described steps, a soaking treatment (or hot forging) is carried out after the melting and casting, if desired; facing is carried out after the hot rolling, if desired; and pickling or grinding, or further degreasing is carried out after each of the heat treatments, if desired. In addition, the "intermediate cold rolling" between the solution treatment and the aging treatment, or the "finish cold rolling" and the "low-temperature annealing" after the aging treatment may be omitted as the case may be. The respective steps are hereunder described.

[Melting and Casting]

A cast slab may be produced by means of continuous casting, semi-continuous casting, or the like. In order to prevent oxidation of Ti from occurring, the production may be carried out in an inert gas atmosphere or in a vacuum melting furnace.

[Hot Rolling]

A general hot rolling method of a copper alloy can be applied. In subjecting the cast slab to hot rolling, by carrying out an initial rolling pass in a high-temperature region of 700° C. or higher where recrystallization easily occurs, the casting texture is ruptured, and such is advantageous in contemplating to homogenize the components and texture. However, when rolling is carried out at a temperature exceeding 950° C., there may be the case where cracking occurs in a place where the melting point decreases, such as a segregated place of the alloy components. It is necessary to carry out the hot rolling in a temperature region not exceeding 950° C. In order to surely carry out the generation of complete recrystallization during the hot rolling step, it is desirable to carry out the rolling at a rolling ratio of 60% or more in a temperature region of from 950° C. to 700° C. In order to prevent the formation and coarsening of the precipitate from occurring, it is effective to carry out the hot rolling at a final pass temperature of 500° C. or higher. After the hot rolling, it is desirable to carry out quenching by means of water cooling or the like.

[Cold Rolling]

In the cold rolling which is carried out before the solution treatment, it is important to control the rolling ratio to 90% or more, and it is more preferable to control the rolling ratio to 95% or more. By subjecting a material worked at such a high rolling ratio to a solution treatment in the subsequent step, a strain which is introduced by rolling functions as a nucleus of the recrystallization, and a crystal grain texture having a uniform crystal grain diameter is obtained. Incidentally, since an upper limit of the cold rolling ratio is inevitably restricted by a mill power or the like, it is not required to be particularly specified. However, from the viewpoint of preventing edge cracking or the like from occurring, a good result is easily obtainable at a rolling ratio of not more than approximately 99%.

[Solution Treatment]

In the case of a Cu—Ti based copper alloy which is subjective in the present invention, in particular, it is important to sufficiently solid-solve a β phase that is a granular precipitate in a solution treatment. In order to achieve this, it is effective to increase the temperature to a temperature region of from 750 to 950° C. and hold it. When the heating temperature of the solution treatment is too low, the solid-solution of the coarse granular β phase becomes insufficient. When the temperature is too high, the crystal grain becomes coarse. In all of these cases, it becomes difficult to obtain finally a high-strength material with excellent bending workability. In addition, in the case where the crystal grain becomes coarse, even when a precursory treatment as described later is carried out, a fine β phase hardly precipitates sufficiently in the grain boundary. In that case, even when aging is carried out at low temperatures, a coarse precipitate of grain boundary reaction type is formed. It is desirable to adjust a heating temperature (maximum ultimate temperature) and a heating and holding time (in-furnace time) such that an average crystal grain diameter of the recrystallized grain (a twin boundary is not considered as the crystal grain boundary) is from 5 to 25 μm. The average crystal grain diameter of the recrystallized grain is more preferably from 8 to 20 μm. The recrystallized grain diameter varies with the cold rolling ratio before the solution treatment or chemical composition. However, by previously determining a relationship between the solution treatment heat pattern and the average crystal grain diameter on each alloy through an experiment, the holding time of the solution treatment can be set up. Specifically, for example, in the case of a cold rolling material having a sheet thickness of from 0.1 to 0.5 mm, an appropriate condition can be set up within a range where the furnace temperature is from 750 to 950° C., and preferably from 780 to 930° C., and the in-furnace time is from 5 seconds to 5 minutes. The average crystal grain diameter after the solution treatment is reflected in an average crystal grain diameter of a final product. That is, the average crystal grain diameter in the final product sheet material is substantially equal to the average crystal grain diameter after the solution treatment.

After completion of the heating process after the solution treatment, a precursory treatment as a subsequent step can be carried out utilizing a cooling process from the heating. In addition, the precursory treatment can also be carried out by after the solution treatment, once decreasing the temperature to the vicinity of ordinary temperature, followed by reheating. In that case, after completion of the heating process subsequent to the solution treatment, quenching is carried out to at least 200° C. at an average cooling rate of 20° C./sec or more.

[Precursory Treatment]

After the solution treatment, the resultant is subjected to a heat treatment (precursory treatment) of holding at a temperature ranging from 550 to 730° C. for from 10 to 120 seconds. This temperature region resides in a temperature range higher than a temperature region of from 450 to 500° C., in which a maximum strength is obtained by the formation of a modulated structure (spinodal structure) in a usual aging treatment of the Cu—Ti based copper alloy. According to studies made by the present inventors, when the Cu—Ti based copper alloy after completion of the solution treatment is held in this temperature region, a fine granular precipitate of β phase is formed in the crystal grain boundary and the grain. Then, it has been noted that when the Cu—Ti based copper alloy of a texture state in which the fine granular precipitate of β phase is existent is subjected to an aging treatment, the formation of a precipitate of grain boundary reaction type is conspicuously suppressed. In addition, it has been noted that in the Cu—Ti based copper alloy of a texture state held in a temperature region of from 550 to 730° C. after the solution treatment, a phenomenon in which a temperature region where in the subsequent aging treatment, the strength becomes maximum, namely an appropriate aging treatment temperature range, shifts towards the low-temperature side occurs. Though reasons for this have not been sufficiently elucidated yet, it may be conjectured that by holding at from 550 to 730° C., a precursory texture structure in which spinodal decomposition starts to occur slightly is obtained, and the peculiar texture structure possibly makes it very easy to bring about full-scale formation of a modulated structure (spinodal structure) from a relatively low temperature. For that reason, in this specification, the holding at from 550 to 730° C. which is carried out after the solution treatment is called "precursory treatment".

When the holding temperature of the precursory treatment is too high, the formation amount of the fine granular β phase is liable to become insufficient. In addition, the crystal grain easily becomes coarse. When the holding temperature is too low, the precipitate of grain boundary reaction type precipitates. On the other hand, when the holding time of the precursory treatment is too long, the granular β phase becomes coarse, and a lowering of the strength is easily brought. When the holding time is too short, the formation amount of the fine granular β phase becomes small, and an action to strengthen the precipitation by the β phase cannot be sufficiently enjoyed. After heating and holding of the precursory treatment, the resultant is quenched to at least 200° C. at an average cooling rate of 20° C./sec or more. When the cooling rate to this temperature is slow, aging occurs in a usual aging treatment temperature region, so that a merit that the aging temperature can be shifted towards the low-temperature side cannot be enjoyed.

The precursory treatment can be carried out utilizing the cooling process of the solution treatment. In that case, the treatment may be carried out using a continuous plate feeding line capable of continuously undergoing the solution treatment and the precursory treatment.

Meanwhile, after heating and holding of the solution treatment, the temperature is decreased to the vicinity of ordinary temperature, and thereafter, the precursory treatment may also be carried out. In that case, a heat pattern in which after heating and holding of the solution treatment, the resultant is quenched to at least 200° C. at an average cooling rate of 20° C./sec or more, and the temperature is then increased and held at a temperature ranging from 550 to 730° C. for from 10 to 120 seconds, followed by quenching to at least 200° C. at an average cooling rate of 20° C./sec or more, is adopted.

[Intermediate Cold Rolling]

Prior to the aging treatment, cold rolling can be applied, if desired. In this specification, the cold rolling at this stage is called "intermediate cold rolling". The intermediate cold rolling has an effect for promoting the precipitation during the aging treatment and is effective for lowering the aging temperature and shortening the aging time for the purpose of bringing out necessary properties (e.g., electrical conductivity and hardness). The rolling ratio of the intermediate cold rolling is required to be not more than 50%, and the rolling ratio of the intermediate cold rolling is more preferably not more than 40%. When the rolling ratio is too high, the bending workability in the TD direction of a final product is deteriorated. In general, the rolling ratio may be adjusted within the range of not more than 20%. This cold rolling step may be omitted.

[Aging Treatment]

In general, an aging treatment of the Cu—Ti based copper alloy is frequently carried out at a temperature ranging from 450 to 500° C. at which an action to increase the strength due to the formation of a modulated structure (spinodal structure) appears most conspicuously. This temperature range simultaneously overlaps a temperature region where a precipitate of grain boundary reaction type is easily formed. For that reason, it was conventionally difficult to suppress the formation of a precipitate of grain boundary reaction type in a Cu—Ti high-strength copper alloy. However, in the case of the Cu—Ti based copper alloy having gone through the above-described precursory treatment, the appropriate aging treatment temperature range for the purpose of obtaining a maximum strength shifts towards the low-temperature side. As described above, it may be considered that this is possibly caused due to the fact that a precursory texture structure in which spinodal decomposition starts to occur slightly is formed due to the precursory treatment, and full-scale formation of a modulated structure (spinodal structure) easily occurs from a relatively low temperature. In consequence, it is possible to carry out the aging treatment to be adopted herein at a temperature at which the material temperature reaches from 300 to 430° C. It is more preferably to carry out the aging treatment at a temperature ranging from 350 to 400° C. An aging time may be, for example, set up in the range of from 60 to 900 minutes in a furnace. In the case of suppressing surface oxidation during the aging treatment as far as possible, a hydrogen, nitrogen, or argon atmosphere can be used.

By combining the above-described precursory treatment with this aging treatment at low temperatures, the formation of a precipitate of grain boundary reaction type is conspicuously suppressed. Examples of reasons for this include the fact that since a fine granular β phase is already formed in the grain boundary by the precursory treatment, new precipitation of grain boundary reaction type hardly occurs; and the fact that the aging treatment temperature falls outside the temperature region where a precipitate of grain boundary reaction type is easily formed and is low. In addition, by going through this aging treatment at this low temperature, it is possible to increase the strength level to one equal to or higher than the conventional level. As for the reason for this, it may be considered that a texture state in which the amount of the coarse β phase is extremely small before the aging treatment is present, and a precipitate of grain boundary reaction type is hardly formed during the aging treatment, and therefore, the amount of solid-solved Ti in the matrix is kept high, and as a result, a high action to increase the strength is possibly exhibited due to a modulated structure on the basis of fluctuation of the concentration of Ti. In addition, it may be considered that the existence of a fine granular β phase formed by the precursory treatment also contributes to precipitation strengthening.

[Finish Cold Rolling]

The strength level (in particular, a 0.2% offset yield strength) can be enhanced by finish cold rolling to be carried out after the aging treatment. The finish cold rolling can be omitted in an application in which the requirement of the strength level is not especially high (for example, the 0.2% offset yield strength is less than 950 MPa). In the case of carrying out the finish cold rolling, it is more effective to ensure a rolling ratio of 5% or more. However, the bending workability in the BW direction (TD) is easily deteriorated with an increase of the finish cold rolling ratio. It is necessary to control the rolling ratio of finish cold rolling to the range of not more than 30%. In general, the finish cold rolling may be carried out within the range of not more than 20%. A final sheet thickness can be, for example, controlled to from 0.05 to 1.0 mm. The final sheet thickness is more preferably from 0.08 to 0.5 mm.

[Low-Temperature Annealing]

After the finish cold rolling, low-temperature annealing can be applied for the purposes of decreasing the residual stress of sheet material or enhancing the bending workability, and enhancing the stress relaxation resistance due to a decrease of dislocation on the vacancy or slip plane. It is desirable to set up a heating temperature such that the material temperature reaches from 150 to 430° C. According to this, it is possible to enhance the strength, the electrical conductivity, the bending workability, and the stress relaxation resistance at the same time. When this heating temperature is too high, the precipitation of grain boundary reaction type easily occurs. Conversely, when the heating temperature is too low, the effects for improving the above-described properties are not sufficiently obtained. It is desirable to ensure a holding time of 5 seconds or more at the above-described temperature, and in general, a good result is obtained in the range within one hour. In the case of omitting the finish cold rolling, in general, this low-temperature annealing is omitted, too.

EXAMPLES

Each of copper alloys shown in Table 1 was melted and cast using a vertical semi-continuous casting machine. The resulting cast slab was heated at 950° C. and then extracted, and hot rolling was started. A final pass temperature of the hot rolling resides between 600° C. and 500° C. A total hot rolling ratio from the cast slab is about 95%. After the hot rolling, an oxidized layer as a surface layer was removed (faced) by means of mechanical grinding, thereby obtaining a rolled sheet having a thickness of 10 mm. Subsequently, the resulting rolled sheet was subjected to cold rolling at various rolling ratios of 90% or more and then provided for a solution treatment. Incidentally, a composition of each of commercially available materials which were used for comparison is described in Table 1.

The solution treatment was carried out at a heating temperature for an in-furnace time shown in Table 2. The in-furnace time was set to 50 seconds. As for a solution treatment condition, an appropriate condition under which an average crystal grain diameter after the solution treatment was from 5 to 25 μm (a twin boundary is not considered as the crystal grain boundary) was adopted exclusive of a part of Comparative Examples. As for the appropriate condition, an optimum temperature was determined through a preliminary experiment depending upon a composition of each of alloys of Examples and decided.

After completion of heating of the solution treatment, a precursory treatment was carried out utilizing a cooling process thereof, or cooling to ordinary temperature was carried out by means of usual water cooling. The precursory treatment utilizing a cooling process was carried out by a method of dipping a sample immediately after heating of the solution treatment in a salt bath adjusted at various temperatures of from 600 to 700° C. and holding it for a prescribed time, followed by water cooling to the vicinity of ordinary temperature at a cooling rate of 50° C./sec or more. In addition, with respect to a part of the samples which had been cooled to ordinary temperature by means of usual water cooling, the precursory treatment was carried out by applying a heat treatment subsequent to the above-described dipping in a salt bath.

Subsequently, intermediate cold rolling was carried out according to need, and an aging treatment was applied at various temperatures of from 300 to 450° C. An aging time was adjusted to a time such that the hardness became a peak at each of the aging temperatures. Thereafter, in a part of the Examples, finish cold rolling and low-temperature annealing were applied, thereby preparing test samples. As for the above-described low-temperature annealing condition, a heating temperature (maximum ultimate temperature) was set to 420° C., and an in-furnace time was set to 60 seconds. Incidentally, facing was carried out on the way according to need, thereby adjusting a sheet thickness of the test material to 0.15 mm. The production condition is shown in Table 2.

TABLE 1

| | | Chemical composition (% by mass) | | | | | | |
|---|---|---|---|---|---|---|---|---|
| Section | No. | Cu | Ti | Fe | Co | Ni | Others | Remark |
| Example according to the present invention | 1 | Balance | 3.25 | — | — | — | — | — |
| | 2 | Balance | 4.68 | — | — | — | — | — |
| | 3 | Balance | 2.22 | — | 0.16 | — | — | — |
| | 4 | Balance | 3.21 | — | — | — | Zr: 0.10, P0.03 | — |
| | 5 | Balance | 2.94 | — | — | 0.15 | B: 0.02 | — |
| | 6 | Balance | 3.26 | 0.18 | — | — | Si: 0.12, Al: 0.08, Zn: 0.46 | — |
| | 7 | Balance | 2.83 | — | — | — | Sn: 0.13, Mn: 0.04, V: 0.14 | — |
| | 8 | Balance | 3.06 | — | — | 0.12 | Cr: 0.12, Mg: 0.06 | — |
| | 9 | Balance | 3.25 | — | — | — | — | — |

TABLE 1-continued

| Section | No. | Chemical composition (% by mass) Cu | Ti | Fe | Co | Ni | Others | Remark |
|---|---|---|---|---|---|---|---|---|
| | 10 | Balance | 3.25 | — | — | — | — | — |
| | 11 | Balance | 3.25 | — | — | — | — | — |
| Comparative Example | 21 | Balance | 3.25 | — | — | — | — | — |
| | 22 | Balance | 4.68 | — | — | — | — | — |
| | 23 | Balance | 2.22 | — | 0.16 | — | — | — |
| | 24 | Balance | 3.21 | — | — | — | Zr: 0.10, P: 0.03 | — |
| | 25 | Balance | 2.94 | — | — | 0.15 | B: 0.02 | — |
| | 26 | Balance | 1.80 | — | — | — | Mg: 0.07 | — |
| | 27 | Balance | 5.41 | — | 0.13 | .0.05 | Zn: 0.05 | — |
| | 28 | Balance | 3.24 | 0.68 | — | — | — | — |
| | 29 | Balance | 3.25 | — | — | — | — | — |
| | 30 | Balance | 3.25 | — | — | — | — | — |
| | 31 | Balance | 3.25 | — | — | — | — | — |
| | 32 | Balance | 3.27 | — | — | — | — | Commercially available C1990-1/2H |
| | 33 | Balance | 3.31 | — | — | — | — | Commercially available C1990-EH |

Underlined: Falling outside the scope of the present invention

TABLE 2

| Section | No. | Production condition: Solution treatment Temperature (° C.) | Time (sec) | Cooling process | Precursory treatment Temperature (° C.) | Time (sec) | Intermediate cold rolling Rolling ratio (%) | Aging treatment Temperature (° C.) | Time (hr) | Finish cold rolling Rolling ratio (%) |
|---|---|---|---|---|---|---|---|---|---|---|
| Example according to the present invention | 1 | 825 | 50 | Carried out precursory treatment | 650 | 50 | 15 | 400 | 5.0 | — |
| | 2 | 900 | 50 | Carried out precursory treatment | 600 | 50 | 5 | 400 | 3.5 | — |
| | 3 | 785 | 50 | Carried out precursory treatment | 700 | 50 | — | 400 | 7.0 | 20 |
| | 4 | 825 | 50 | Carried out precursory treatment | 650 | 50 | 6 | 400 | 5.0 | — |
| | 5 | 800 | 50 | Carried out precursory treatment | 675 | 50 | 10 | 400 | 5.5 | 10 |
| | 6 | 825 | 50 | Carried out precursory treatment | 650 | 50 | — | 400 | 5.0 | 10 |
| | 7 | 800 | 50 | Carried out precursory treatment | 675 | 50 | — | 400 | 6.0 | 15 |
| | 8 | 800 | 50 | Carried out precursory treatment | 675 | 50 | 10 | 400 | 5.5 | — |
| | 9 | 825 | 50 | Water cooling | 650 | 50 | 15 | 400 | 5.0 | — |
| | 10 | 825 | 50 | Carried out precursory treatment | 650 | 50 | 15 | 300 | 12.0 | — |
| | 11 | 825 | 50 | Carried out precursory treatment | 650 | 50 | 15 | 430 | 4.0 | — |
| Comparative Example | 21 | 825 | 50 | Water cooling | — | — | 15 | 450 | 5.0 | — |
| | 22 | 900 | 50 | Water cooling | — | — | 5 | 450 | 3.5 | — |
| | 23 | 785 | 50 | Water cooling | — | — | — | 450 | 7.0 | 20 |
| | 24 | 825 | 50 | Water cooling | — | — | 6 | 450 | 5.0 | |
| | 25 | 800 | 50 | Water cooling | — | — | 10 | 450 | 5.5 | 10 |
| | 26 | 750 | 50 | Carried out precursory treatment | 700 | 50 | — | 400 | 8.0 | 15 |
| | 27 | — | — | — | — | — | — | — | — | — |
| | 28 | 850 | 50 | Carried out precursory treatment | 650 | 50 | 15 | 400 | 5.0 | — |
| | 29 | 960 | 50 | Carried out precursory treatment | 650 | 50 | 15 | 400 | 5.0 | — |
| | 30 | 730 | 50 | Carried out precursory treatment | 650 | 50 | 15 | 400 | 3.5 | — |
| | 31 | 825 | 50 | Carried out precursory treatment | 650 | 150 | 15 | 400 | 3.5 | — |
| | 32 | — | — | — | — | — | — | — | — | — |
| | 33 | — | — | — | — | — | — | — | — | — |

In Table 1, No. 32 and No. 33 are concerned with test materials prepared by obtaining commercially available Cu—Ti based copper alloys C1990-1/2H and C1990-EH (sheet thickness: 0.15 mm), respectively. Test pieces were collected from the respective test materials after the aging treatment or low-temperature annealing, as obtained in the above-described steps, and the test materials using a commercially available material (sheet thickness of all of the materials: 0.15 mm) and examined with respect to an average crystal grain diameter, a width of a precipitate of grain boundary reaction type, a density of a granular precipitate having a diameter of 100 nm or more, an electrical conductivity, a tensile strength, a 0.2% offset yield strength, fatigue resistance, stress relaxation resistance, and bending workability.

The textures and properties were examined in the following manners.

[Average Crystal Grain Diameter]

A sheet surface (rolled surface) of the test material was polished and then subjected to etching, the resulting surface was observed by an optical microscope, and a grain diameter of 100 or more crystal grains in a visual field of 300 μm×300 μm was measured by the cutting method of JIS H0501.

[Precipitate of Grain Boundary Reaction Type and Coarse Granular Precipitate]

A sheet surface (rolled surface) of the test material was polished, and the resulting surface was observed by a scanning electron microscope (SEM, magnification: 3,000 times, observation field: 42 μm×29 μm) in randomly selected five visual fields.

A maximum value of a length of the precipitate of grain boundary reaction type in the rectangular direction to a crystal grain boundary on which the precipitate of grain boundary reaction type was formed, the length being measured at a position above the crystal grain boundary in the five visual fields, was defined as a maximum width of the precipitate of grain boundary reaction type.

A density of the coarse granular precipitate was determined by dividing the number of granular precipitates having a diameter of 100 nm or more, as observed in the five visual fields, by a total area of the visual fields.

[Electrical Conductivity]

An electrical conductivity of each of the test materials was measured in conformity with JIS H0505.

[Tensile Strength and 0.2% Offset Yield Strength]

A tensile test piece (JIS No. 5) of LD was collected from each of the test materials, subjected to a tensile test at n=3 according to JIS Z2241, and measured with respect to a tensile strength and a 0.2% offset yield strength. The tensile strength and the 0.2% offset yield strength were determined in terms of an average value at n=3.

[Bending Workability]

A bending test piece in which LD is the longitudinal direction and a bending test piece in which TD is the longitudinal direction (width of all of the test pieces: 10 mm) were collected from the sheet material of the test material and subjected to the 90° W-bending test in conformity with JIS H3130. With respect to the test piece after the test, a surface and a cross section of the bending-worked part were observed by an optical microscope with a magnification of 100 times. A minimum bending radius R at which cracking did not occur was determined, and this was divided by a sheet thickness t of the test material, thereby determining an R/t value (MBR/t) of each of LD and TD. The test was carried out at n=3 in each of LD and TD of each test material, and a record of the test piece in which the worst result was presented at n=3 was adopted, thereby expressing an R/t value. Incidentally, in the case where cracking occurred under a bending condition of R/t=5.0, a test was not carried out at an R value more than this. That case is expressed by "ruptured".

[Fatigue Resistance]

The fatigue test was carried out using a test piece in the parallel direction to the rolling direction in conformity with JIS Z2273. One end of a strip-shaped test piece having a width of 10 mm was fixed by a fixing tool, and the other end was given sinusoidal wave vibration via a knife edge, thereby measuring a fatigue life. A fatigue life at a maximum load stress of 700 MPa on the test piece surface (the number of repeated vibrations until rupture of the test piece occurred) was measured. The measurement was carried out 4 times under the same condition, thereby determining an average value of the measurement of 4 times.

[Stress Relaxation Properties]

A bending test piece (width: 10 mm) in which TD was the longitudinal direction was collected from each of the test materials and fixed in an arched state such that the surface stress in a central part in the longitudinal direction of the test piece was 80% in terms of a 0.2% offset yield strength. The above-described surface stress is defined according to the following equation:

$$\text{Surface stress (MPa)}=6Et\delta/L_0^2$$

wherein

E: Elastic modulus (MPa)

t: Thickness of the sample (mm)

δ: Deflection height of the sample (mm)

A stress relaxation rate was calculated from a bending habit after holding the test piece in this state in the air at a temperature of 200° C. for 1,000 hours according to the following equation:

$$\text{Stress relaxation rate (\%)}=(L_1-L_2)/(L_1-L_0)\times 100$$

wherein $L_0$: Length of the tool, namely a horizontal distance between the ends of the sample fixed during the test (mm)

$L_1$: Length of the sample at the time of starting the test (mm)

$L_2$: Horizontal distance between the ends of the sample fixed after the test (mm)

The test sample having this stress relaxation rate of not more than 5% was evaluated to have high durability as an on-board connector and decided to be good enough.

These results are shown in Table 3. LD and TD described in Table 3 are a direction coincident with the longitudinal direction of the test piece.

TABLE 3

| | | Texture | | | Properties | | | | | | |
|---|---|---|---|---|---|---|---|---|---|---|---|
| | | Average crystal grain diameter | Width of precipitate of grain boundary reaction type | Density of granular precipitate having a diameter of 100 nm or more | Electrical conductivity | Tensile strength (MPa) | 0.2% offset yield strength (MPa) | Bending workability (MBR/t) | | Fatigue life (times × 10,000) | Stress relaxation rate (%) |
| Section | No. | (μm) | (nm) | ($10^4$ number/mm$^2$) | (% IACS) | LD | LD | LD | TD | LD | TD |
| Example according to the present invention | 1 | 12 | <100 | 2.4 | 16.8 | 1065 | 975 | 0.0 | 1.6 | 214 | 2.1 |
| | 2 | 8 | <100 | 4.5 | 15.2 | 1094 | 1002 | 0.0 | 1.0 | 305 | 2.4 |
| | 3 | 16 | <100 | 1.7 | 18.6 | 936 | 892 | 0.0 | 0.7 | 87 | 3.2 |
| | 4 | 10 | <100 | 3.1 | 17.2 | 956 | 873 | 0.0 | 0.0 | 96 | 2.8 |
| | 5 | 14 | <100 | 1.9 | 19.6 | 948 | 906 | 0.0 | 0.7 | 112 | 3.4 |
| | 6 | 7 | <100 | 2.0 | 17.2 | 995 | 945 | 0.0 | 1.6 | 145 | 3.1 |
| | 7 | 16 | <100 | 2.5 | 18.2 | 950 | 901 | 0.0 | 0.0 | 165 | 3.3 |
| | 8 | 20 | <100 | 1.2 | 20.6 | 916 | 867 | 0.0 | 0.0 | 76 | 3.6 |
| | 9 | 12 | <100 | 2.3 | 17.0 | 1070 | 981 | 0.0 | 1.6 | 222 | 2.0 |
| | 10 | 12 | <100 | 2.1 | 16.3 | 1085 | 992 | 0.0 | 1.0 | 236 | 2.0 |
| | 11 | 12 | <100 | 2.6 | 17.4 | 1035 | 956 | 0.0 | 1.0 | 204 | 2.3 |
| Comparative Example | 21 | 12 | 1850 | 2.2 | 12.3 | 875 | 764 | 1.0 | 2.0 | 16 | 4.6 |
| | 22 | 8 | 3680 | 4.2 | 11.7 | 946 | 843 | 1.0 | 3.0 | 13 | 4.9 |
| | 23 | 16 | 1240 | 1.7 | 12.7 | 913 | 849 | 1.0 | 1.6 | 24 | 4.2 |

TABLE 3-continued

| | | Texture | | | Properties | | | | | | |
|---|---|---|---|---|---|---|---|---|---|---|---|
| | | Average crystal grain diameter | Width of precipitate of grain boundary reaction type | Density of granular precipitate having a diameter of 100 nm or more | Electrical conductivity | Tensile strength (MPa) | 0.2% offset yield strength (MPa) | Bending workability (MBR/t) | | Fatigue life (times × 10,000) | Stress relaxation rate (%) |
| Section | No. | (μm) | (nm) | ($10^4$ number/mm$^2$) | (% IACS) | LD | LD | LD | TD | LD | TD |
| | 24 | 10 | 890 | 3.0 | 13.2 | 782 | 644 | 0.0 | 0.7 | 0.5 | 4.4 |
| | 25 | 14 | 1060 | 1.8 | 14.1 | 956 | 900 | 1.0 | 3.0 | 28 | 4.5 |
| | 26 | 18 | <100 | 1.3 | 22.5 | 812 | 765 | 0.0 | 0.7 | 32 | 5.2 |
| | 27 | — | — | — | — | — | — | — | — | — | — |
| | 28 | 4 | <100 | 15.0 | 17.6 | 928 | 845 | 2.0 | 3.0 | 27 | 5.2 |
| | 29 | 65 | 1150 | 0.6 | 14.3 | 1012 | 921 | 1.0 | 4.0 | 18 | 4.6 |
| | 30 | 4 | <100 | 26.0 | 18.4 | 862 | 777 | 1.0 | 3.0 | 24 | 6.2 |
| | 31 | 12 | <100 | 18.0 | 17.4 | 954 | 842 | 1.5 | 3.0 | 35 | 4.4 |
| | 32 | 7 | 1460 | 3.3 | 13.1 | 846 | 738 | 1.5 | 2.0 | 12 | 5.8 |
| | 33 | 7 | 1650 | 3.9 | 12.4 | 958 | 874 | 2.0 | 4.0 | 16 | 6.2 |

As is noted from Table 3, all of the copper alloy sheet materials according to the present invention have an average crystal grain diameter of from 5 to 25 μm, a width of a precipitate of grain boundary reaction type of not more than 500 nm, and a density of a granular precipitate having a diameter of 100 nm or more of not more than $10^5$ number/mm$^2$ and also have a high strength such that a 0.2% offset yield strength thereof is 850 MPa or more, good bending workability such that an R/t value thereof is not more than 2.0 in both LD and TD, and excellent fatigue resistance such that a fatigue life thereof at a load stress of 700 MPa is 500,000 times or more. The width of the precipitates of grain boundary reaction type of the Examples according to the present invention was specifically less than 100 nm and was on a level of being not substantially perceived. Furthermore, all of the copper alloy sheet materials according to the present invention also have excellent stress relaxation resistance such that the stress relaxation rate of TD which is important in an application of an onboard connector or the like is 5% or less. In addition, the electrical conductivity of all of the copper alloy sheet materials according to the present invention is also improved as compared with C1990 (Nos. 32 and 33) representing a usual Cu—Ti based copper alloy.

On the other hand, Comparative Examples Nos. 21 to 25 are concerned with an example in which the alloys having the same composition as that in Example Nos. 1 to 5 according to the present invention were produced by usual steps (those quenched after the solution treatment), respectively. In all of these Comparative Examples, the formation of a precipitate of grain boundary reaction type is not suppressed, and the strength, bending workability, fatigue resistance, stress relaxation resistance, electrical conductivity, and the like are generally inferior to those in the Examples according to the present invention.

Comparative Examples Nos. 26 to 28 are concerned with an example in which good properties were not obtained in view of the fact that the chemical composition falls outside the scope of the present invention. No. 26 is low in the strength level and inferior in the fatigue resistance because of an excessively low content of Ti. No. 27 could not take an appropriate solution treatment condition because of an excessively high content of Ti, so that cracking occurred on the way of production, and a sheet material capable of being evaluated could not be prepared. No. 28 was substantially free from the precipitation of grain boundary reaction type because Fe was added for the purpose of suppressing the precipitation of grain boundary reaction type; however, Fe and Ti formed a coarse intermetallic compound (granular precipitate) in view of the fact that the addition amount of Fe was in excess, and all of the strength, bending workability, fatigue resistance, and stress relaxation resistance were deteriorated.

Comparative Examples Nos. 29 to 31 are concerned with an example in which good properties were not obtained in view of the fact that with respect to the alloy having the same composition as that in Example No. 1 according to the present invention, the heating and holding condition of the solution treatment or the precursory treatment condition falls outside the scope of the present invention. In No. 29, the crystal grain was coarsened because of an excessively high heating temperature of the solution treatment relative to the holding time of 50 seconds, and nevertheless the precursory treatment was applied during the subsequent cooling, the progress of precipitation of grain boundary reaction type was not sufficiently suppressed during the aging treatment. As a result, good fatigue resistance was not obtained. In addition, the bending workability was inferior due to coarsening of the crystal grain. In No. 30, since the solution treatment temperature was conversely too low as 730° C., a large amount of the granular precipitate having a diameter of 100 nm or more remained (in a solid-unsolved state). In that case, though the precipitation of grain boundary reaction type could be suppressed during the aging treatment, bad results were brought in all of the strength, fatigue resistance, bending workability, and stress relaxation resistance. In No. 31, since the holding time of the precursory treatment was too long, the granular precipitate was excessively formed. As a result, though the precipitation of grain boundary reaction type could be suppressed during the aging treatment, the strength, fatigue resistance, and bending workability were inferior.

Comparative Examples Nos. 32 and 33 are commercially available products of C1990-1/2H and C1990-EH representing the Cu—Ti based copper alloy. In all of them, a precipitate of grain boundary reaction type having a width exceeding 500 nm is formed, and as compared with Example No. 1 according to the present invention having substantially the same composition, all of the strength, fatigue resistance, bending workability, stress relaxation resistance, and electrical conductivity are inferior.

Figure 2:
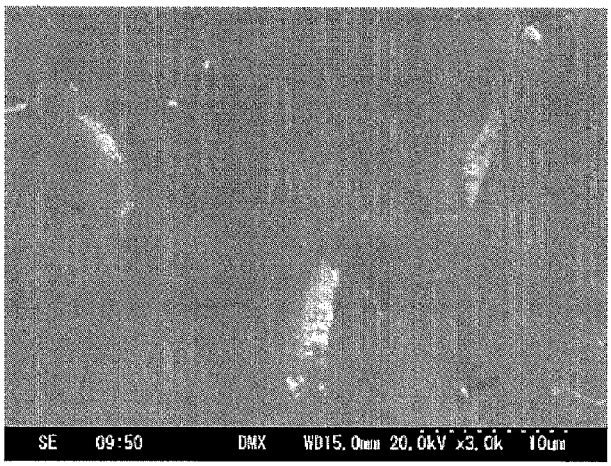
FIG. 2 is an SEM photograph of metallic texture of Comparative Example No. 21 produced in usual steps.
Figure 3:
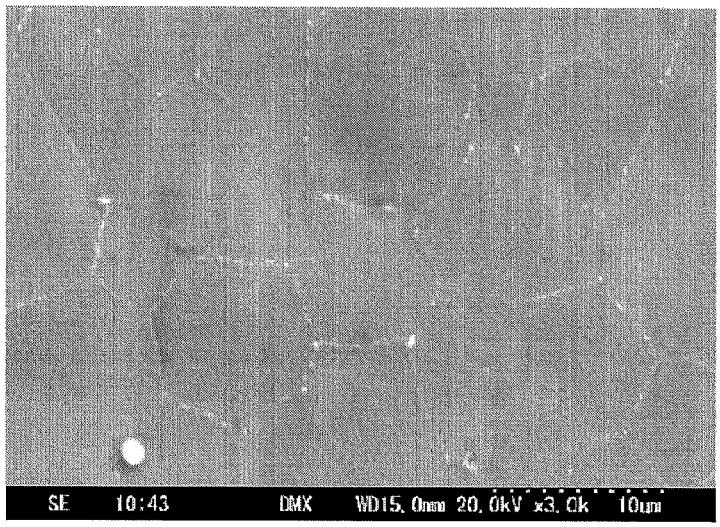
FIG. 3 is an SEM photograph of metallic texture of Example No. 1 according to the present invention.

An SEM photograph of a cross section perpendicular to the sheet thickness direction with respect to the test material of Comparative Example No. 21 which was produced in usual steps is illustrated in FIG. 2. In addition, an SEM photograph similar to that in FIG. 2 with respect to the test material of Example No. 1 according to the present invention using an alloy having the same composition as that in FIG. 2 is illustrated in FIG. 3. In FIG. 2 (Comparative Example), a large number of precipitates of grain boundary reaction type having a width largely exceeding 500 nm are observed. On the other hand, the presence of a precipitate of grain boundary reaction type is not confirmed in FIG. 1 (Example according to the present invention).

The invention claimed is:

1. A copper alloy sheet material which comprises from 2.0 to 5.0% of Ti, from 0 to 1.5% of Ni, from 0 to 1.0% of Co, from 0 to 0.5% of Fe, from 0 to 1.2% of Sn, from 0 to 2.0% of Zn, from 0 to 1.0% of Mg, from 0 to 1.0% of Zr, from 0 to 1.0% of Al, from 0 to 1.0% of Si, from 0 to 0.1% of P, from 0 to 0.05% of B, from 0 to 1.0% of Cr, from 0 to 1.0% of Mn, and from 0 to 1.0% of V in terms of % by mass, with a total content of Sn, Zn, Mg, Zr, Al, Si, P, B, Cr, Mn, and V being not more than 3.0% and the balance being Cu and inevitable impurities, wherein the copper alloy sheet material has a metallic texture in which in a cross section thereof perpendicular to the sheet thickness direction, a maximum width of a precipitate of grain boundary reaction type is not more than 500 nm, and a density of a granular precipitate having a diameter of 100 nm or more is not more than $10^5$ number/$mm^2$.

2. The copper alloy sheet material according to claim 1, wherein the metallic texture further has an average crystal grain diameter of from 5 to 25 μm in a cross section thereof perpendicular to the sheet thickness direction.

3. The copper alloy sheet material according to claim 1, wherein the copper alloy sheet material has an electrical conductivity of 15% IACS or more.

4. The copper alloy sheet material according to claim 1, wherein when the rolling direction of the sheet is defined as LD, and the direction rectangular to the rolling direction and the sheet thickness direction is defined as TD, the copper alloy sheet material has a 0.2% offset yield strength in LD of 850 MPa or more and has bending workability such that in the 90° W-bending test in conformity with JIS H3130, a value of R/t ratio of a minimum bending radius R to a sheet thickness t at which cracking does not occur is not more than 2.0 in both LD and TD.

5. The copper alloy sheet material according to claim 1, wherein the copper alloy sheet material has fatigue resistance such that in the fatigue test in conformity with JIS Z2273, a test piece in which the rolling direction of the sheet is the longitudinal direction has a fatigue life at a maximum load stress of 700 MPa on the test piece surface (the number of repeated vibrations until rupture of the test piece occurs) is 500,000 times or more.

6. A method for producing a copper alloy sheet material according to claim 1, comprising a step of subjecting a sheet material having been subjected to hot rolling and cold rolling at a rolling ratio of 90% or more, to a heat treatment with a heat pattern including a solution treatment at from 750 to 950° C., holding at a temperature ranging from 550 to 730° C. in a cooling process after the solution treatment for from 10 to 120 seconds, and then quenching to at least 200° C. at an average cooling rate of 20° C./sec or more; and a step of subjecting the sheet material after the heat treatment successively to intermediate cold rolling at a rolling ratio of from 0 to 50%, an aging treatment at from 300 to 430° C., and finish cold rolling at a rolling ratio of from 0 to 30%.

7. A method for producing a copper alloy sheet material according to claim 1, comprising a step of subjecting a sheet material having been subjected to hot rolling and cold rolling at a rolling ratio of 90% or more, to a heat treatment with a heat pattern including a solution treatment at from 750 to 950° C., then quenching to at least 200° C. at an average cooling rate of 20° C./sec or more, thereafter increasing the temperature and holding at a temperature ranging from 550 to 730° C. for from 10 to 120 seconds, and then quenching to at least 200° C. at an average cooling rate of 20° C./sec or more; and a step of subjecting the sheet material after the heat treatment successively to intermediate cold rolling at a rolling ratio of from 0 to 50%, an aging treatment at from 300 to 430° C., and finish cold rolling at a rolling ratio of from 0 to 30%.

8. The method for producing a copper alloy sheet material according to claim 6, wherein the method includes controlling a rolling ratio of the finish cold rolling to from 5 to 30% and then applying low-temperature annealing at from 150 to 430° C.

9. The method for producing a copper alloy sheet material according to claim 6, wherein the method includes adjusting a heating time and an in-furnace time in the solution treatment such that an average crystal grain diameter in a cross section perpendicular to the sheet thickness direction after the final cold rolling is from 5 to 25 μm.

10. An electric current carrying component using the copper alloy sheet material according to claim 1 for a material.

* * * * *